US005385415A

United States Patent [19]

Quattrini

[11] Patent Number: 5,385,415

[45] Date of Patent: Jan. 31, 1995

[54] DOT MATRIX PRINTING HEAD WITH VARIABLE ARMATURE ABUTMENTS

[75] Inventor: Ettore Quattrini, Binasco, Italy

[73] Assignee: Bull HN Information Systems Italia S.p.A., Turin, Italy

[21] Appl. No.: 234,064

[22] Filed: Apr. 28, 1994

[30] Foreign Application Priority Data

Apr. 28, 1993 [EP] European Pat. Off. ..... 93830181

[51] Int. Cl.[6] ..... B41J 2/27

[52] U.S. Cl. ..... 400/124.22; 400/55

[58] Field of Search ..... 400/55, 56, 57, 124.17, 400/124.21, 124.22

[56] References Cited

U.S. PATENT DOCUMENTS

| | | | |
|---|---|---|---|
| 4,609,294 | 9/1986 | Gomoll et al. | 400/59 |
| 4,613,243 | 9/1986 | Rossi et al. | 400/124.22 |
| 5,188,466 | 2/1993 | Kasper | 400/124.22 |

FOREIGN PATENT DOCUMENTS

| | | | |
|---|---|---|---|
| 418433 | 9/1989 | European Pat. Off. | B41J 2/24 |
| 61-246068 | 11/1986 | Japan | B41J 3/10 |
| 4115958 | 4/1992 | Japan | B41J 2/275 |
| 2258548 | 6/1992 | United Kingdom | B41J 2/30 |

*Primary Examiner*—Kimberly L. Asher
*Assistant Examiner*—Steven S. Kelley
*Attorney, Agent, or Firm*—Edward D. Manzo; Ted K. Ringsred

[57] ABSTRACT

A dot matrix printing head and related printing apparatus, the print head comprising a plurality of printing electromagnets, each having a magnetic core, an energization winding, a movable armature for actuation of a printing element and a first abutment element defining a first rest position of the armatures, where electrically energizeable means are provided for controlling the position of a second abutment element which defines a second rest position of the armatures, so as to change the air gap width between each armature and the related magnetic core and the stroke of the related printing element, depending on requirement of printing on single copy sheets or multiple copy sheets, and where, in addition to gap adjustment, the duration of the energization time interval of the printing electromagnets, their energization frequency and the advancement speed of the print head relative to a printing medium are modified to achieve the best performances, both when printing on single copy sheet and on multiple copy sheets.

5 Claims, 3 Drawing Sheets

DOT MATRIX PRINTING HEAD WITH VARIABLE ARMATURE ABUTMENTS

BACKGROUND OF THE INVENTION

The present invention relates to a dot matrix printing head and a printing apparatus using such head.

It is known that serial impact dot matrix printers are broadly used as computer peripherals by reason of their reliability, low cost, versatility and high printing speed.

When suitably driven by printing control programs they can virtually print any kind of fonts, as well as diagrams and drawings, on several kind of printing supports, from thin paper sheets to multiple copy forms.

The achievable printing speed is very high. The same equipment may achieve a speed of 600 characters per second when printing in draft mode, and a speed of 200 characters per second when printing in near letter quality mode.

The factor which limits the printing speed is essentially the maximum needle operative frequency which, in turn, is determined by the time required to energize an electromagnet, driving the needle against the printing support, and by the time required for the needle to return in a rest position, after it has impacted on the printing medium.

Today operative frequencies in the range of 2000–2500 Hz can be attained, which however impose some restriction as to the operative conditions of the printing device.

The shorter is the stroke requested to the needles and the lesser is the energy which the needle has to transfer by impact to the printing medium, the higher is the operative frequency.

A short stroke and a low impact energy impose a limit to the thickness of the printing medium and the number of copies which may be printed, which may be overcome, partially, by the precise machining of the printing apparatus and its set up.

The printing apparatuses of today have therefore to set a compromise between the operative printing speed and the characteristics of the printing medium.

If the printer has to print on multiple copy paper, the print head must be designed and set up to this purpose, achieves a maximum operative frequency related thereto and even when printing on single sheets the maximum operative frequency remains the same.

This problem is overcome by the dot matrix printing head of the present invention which is provided with means for dinamycally changing its set up on demand, so as to establish the most suitable operative conditions as a function of the characteristics of the printing support.

The stroke of the needle, in a print head of today, where the needle is driven by an end of an electromagnet armature, acting as a lever actuated by electromagnet energization, is determined by the width of the air gap existing between the electromagnet and the armature at rest.

The gap width is set up in the manufacturing process.

According to the invention means are provided to dynamically change the gap width on operator command, so as to set it at best for the requested operative purpose.

DESCRIPTION OF THE PRIOR ART

Attempts in this direction have been already proposed.

EP-A-0418433 discloses a print head where the rest position of the armature is not set by the manufacturing process but is controlled by a rotating motor which, acting on a screw, adjusts the position of a resilient abutment member so as to change the gap width depending on the thickness of the paper and the number of copies to be printed.

As a possible alternative the rotating motor may be substituted with an electromagnetic plunger which sets the resilient abutment member in either one or the other of two positions, each one tailored to a predetermined paper tickness and number of copies, single or multiple, to be printed.

The gap adjustment is further combined with an adjustment of the energization time of the printing electromagnets so as to attain the most suitable operative conditions in all occurrencies and at the same time the maximum operative speed.

This approach have several drawbacks.

The use of a motor driven screw for adjustment introduces unacceptable allowances, which tends to increase with operation and results in a limited print head operative life and frequent maintenance operations.

Since the resilient abutment member is in form of a ring axially driven and supported by the screw and each of the several armatures rests against a specify sector of the ring, the elastical response of the abutment member is uneven, and at some extent unpredictable, because the armatures and not all of them, return to the rest position, against the abutment member, upon actuation, at different times and different locations of the abutment member. Oscillation of the abutment member, around its central axis may be induced.

Moreover, the motor cannot be inglobed in plastic to form a unitary assembly including electromagnets and gap adjustment actuator: fixing means are required to fix the motor to a print head frame.

In case of abutment member controlled by an electromagnetic plunger the stroke of the plunger must be carefully set and trimmed in order to establish two predetermined steady position for the abutment member and the trimming operation adds to the manufacturing cost of the print head.

SUMMARY OF THE INVENTION

These drawbacks are entirely avoided by the dot matrix print head of the present invention, where two distinct abutment members are provided to adjust the gap width for optimized performances depending on the number of copies to be printed and the required impact energy.

A first of the abutment members is fixed in position and suitably machined to set a predetermined armature gap width, suitable for printing on multiple copy paper.

The second abutment member is movable between two position one of which imposed by a resilient means, the other by the energization of electromagnetic means.

In one of the two positions, the second abutment member interferes with the electromagnet armatures preventing them from resting against the first abutment member and setting an armature gap width suitable for printing on thin or single copy paper.

In the other of the two position, the second abutment member is retracted and does not interferes with the electromagnet armatures allowing them to rest against the first abutment member.

Since in the retracted position the second abutment member is inactive, there is no need to precisely adjust the retracted position and the second abutment member may be easily machined to provide the desired gap width only when set in the active position.

Preferably, but not exclusively, the electromagnetic means for actuating the second abutment member comprises an electromagnetic actuator having a movable plunger or armature and a bias spring.

Moreover the modification of the air gap and the related stroke of the needles is combined with a modification in the energization time of the electromagnets, the energization time being increased or extended when the air gap is wider, so as to positively drive the armature for the whole time required to attract it and to close the gap.

By the combined effect of a time extended energization and gap broadening, not only a longer needle stroke is achieved, but also greater kinetic energy is imparted to the armature and to the needle, resulting in a stronger impression on the print medium, adequate for printing on a multiple copy form.

BRIEF DESCRIPTION OF THE DRAWINGS

The features and the advantages of the invention will appear more clearly from the following description of a preferred form of embodiment and from the enclosed drawing where.

DESCRIPTION OF THE PREFERRED EMBODIMENT

Figure 1:
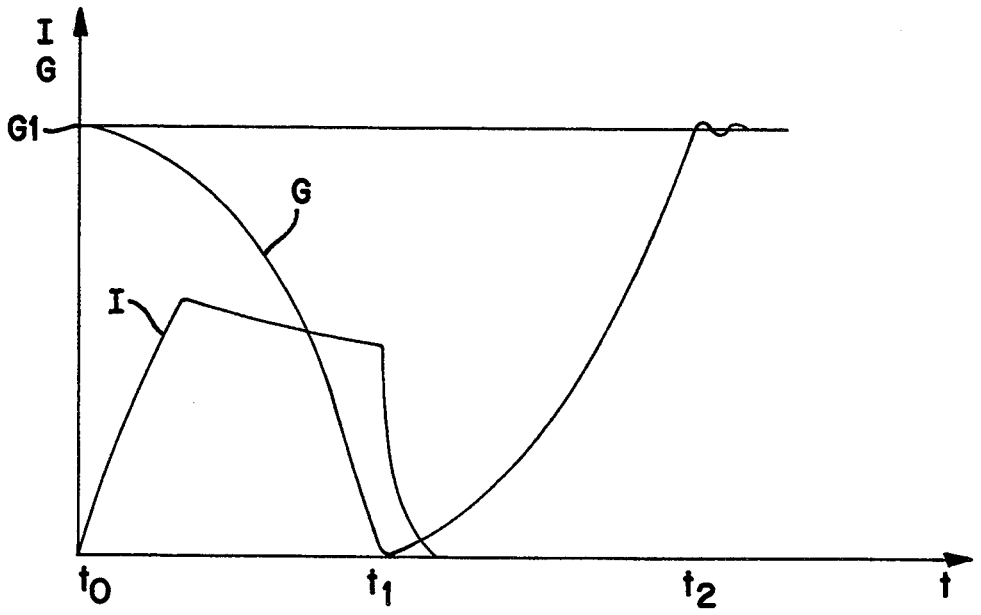
FIG. 1 shows in timing diagram the operation of a printing electromagnetic where the air gap has a width G1.

For a better understanding of the invention, FIG. 1 shows in timing diagram the operation of a printing electromagnet used to drive a printing element such as a print head needle.

The electromagnet may be either of the plunger type or of the movable armature type, although movable armature electromagnets are preferably used.

The diagram shows the energization current I and the air gap G change occurring when the electromagnet is energized.

When the electromagnet is deenergized the plunger or armature rests against a stop element which defines an open gap G1, having a predetermined width, which is set in order to achieves the maximum attainable performances from the printing element (printing speed, stroke, and impact energy).

When the electromagnet is energized, at an instant $t_o$, current is build up in the winding as fast as possible, up to a maximum value set in order to avoid saturation, and thereafter, by chopping techniques or other current limiting methods, the current is maintained until time t1.

At the same time, due to the actractive force exerted by the electromagnet, the plunger/armature begins to move, and the gap width decreases, and is zeroed at time $t_1$.

It may be roughly said that during time interval $t_o$-t1, the armature/plunger moves with a constant acceleration "a" and the speed attained at time $t_1$ is given by "a" $(t_1-t_o)$.

At time $t_1$, when the armature/plunger has its maximum kinetic energy, the printing element (needle) coupled thereto impacts against the printing support and rebounds.

The plunger/armature, no more subjected to the electromagnet attraction, returns then to the rest position, owing to rebound and resilied means, which bias it in rest position.

Always roughly it may be assumed that at time $t_2$ the armature and printing element are again in rest position, ready for another energization, the time interval $t_1$-$t_2$ equalling $t_o$-$t_1$.

The frequency at which the electromagnet can operate is therefore given by $f_1=1/(t_2-t_o)$.

The time $t_1$, hence the duration of interval $t_o$-$t_1$ is predetermined, so as to impart the maximum speed to the armature, without braking and preeventing the armature return.

Assuming that FIG. 1 shows the operation of an electromagnet, set for best performance when printing on a single sheet of paper, the printing quality, when printing with the same electromagnet on a multiple copy form would be very poor.

It is readly apparent that in order to obtain a good printing quality from the same printing electromagnet, when printing on a multiple copy form, more kinetic energy is required from the armature/plunger, and this can be obtained by combining two factors: and energization of the electromagnet having a longer duration and departure of the armature from a rest position defining a broader gap and stroke.

In fact, the maximum value of the energization current, cannot be increased, because it is limited by the saturation of the magnetic circuit.

Figure 2:
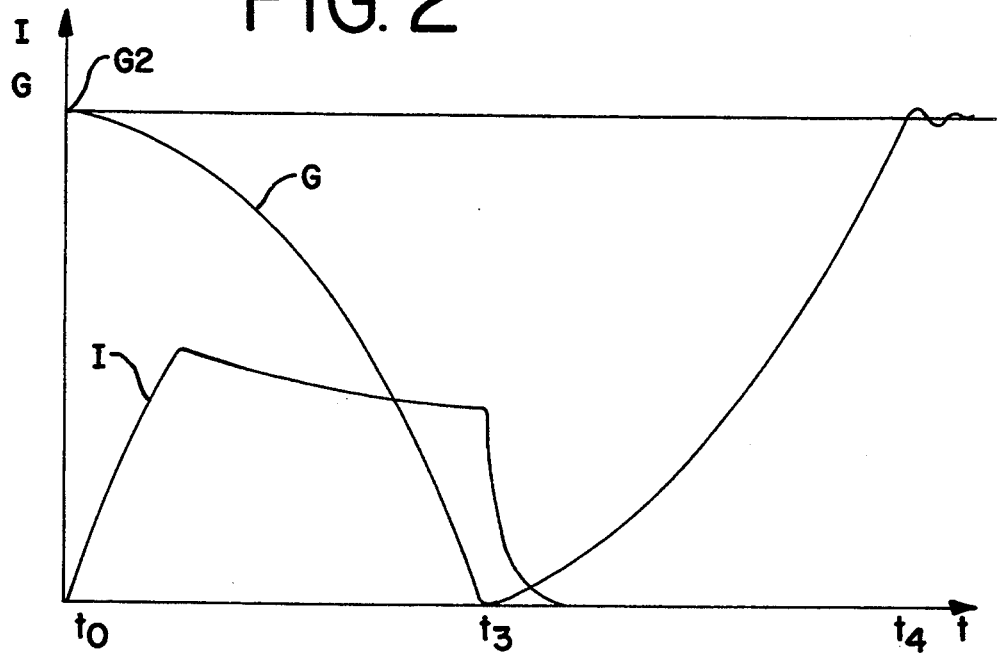
FIG. 2 shows, in timing diagram, the operation of the same electromagnetic of FIG. 1, when the air gap has a width G2 greater than G1.

This situation is depicted in FIG. 2, which shows the change in gap width occurring when the electromagnet is energized departing from an open gap G2 greater than G1.

In this case, zeroing of the gap is achieved at a time $t_3$ defining a time interval $t_o$-$t_3$ greater than $t_o$-$t_1$ and allowing for a further energization of the electromagnet, which results in greater kinetic energy of the armature.

Clearly the trade off is a lower operative frequency of the electromagnet which drops to $f_2=1/(t_4-t_o)$, $t_4$ being the time instant at which the armature attains again the rest position.

If it is possible to dynamically change the gap under suitable control and at the same time to change the energization time interval of the electromagnet, the best performance can be obtained from the printing apparatus in that it become possible to print at the maximum attainable speed, when printing on single sheet, and to switch to a multiple copy print mode on demand, whenever required.

Figure 3:
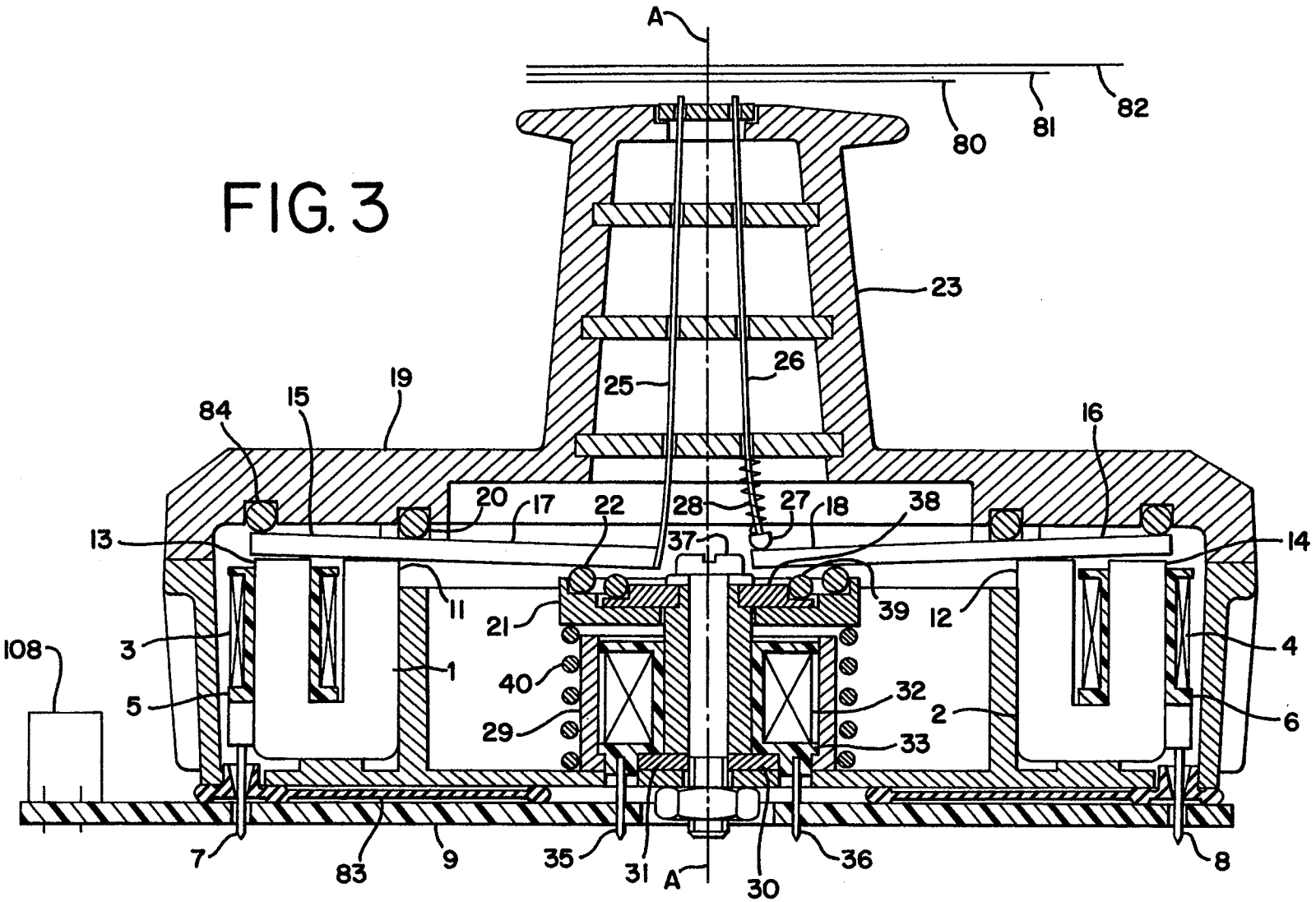
FIG. 3 shows in section view a preferred form of embodiment for a print head in accordance with the invention.
Figure 4:
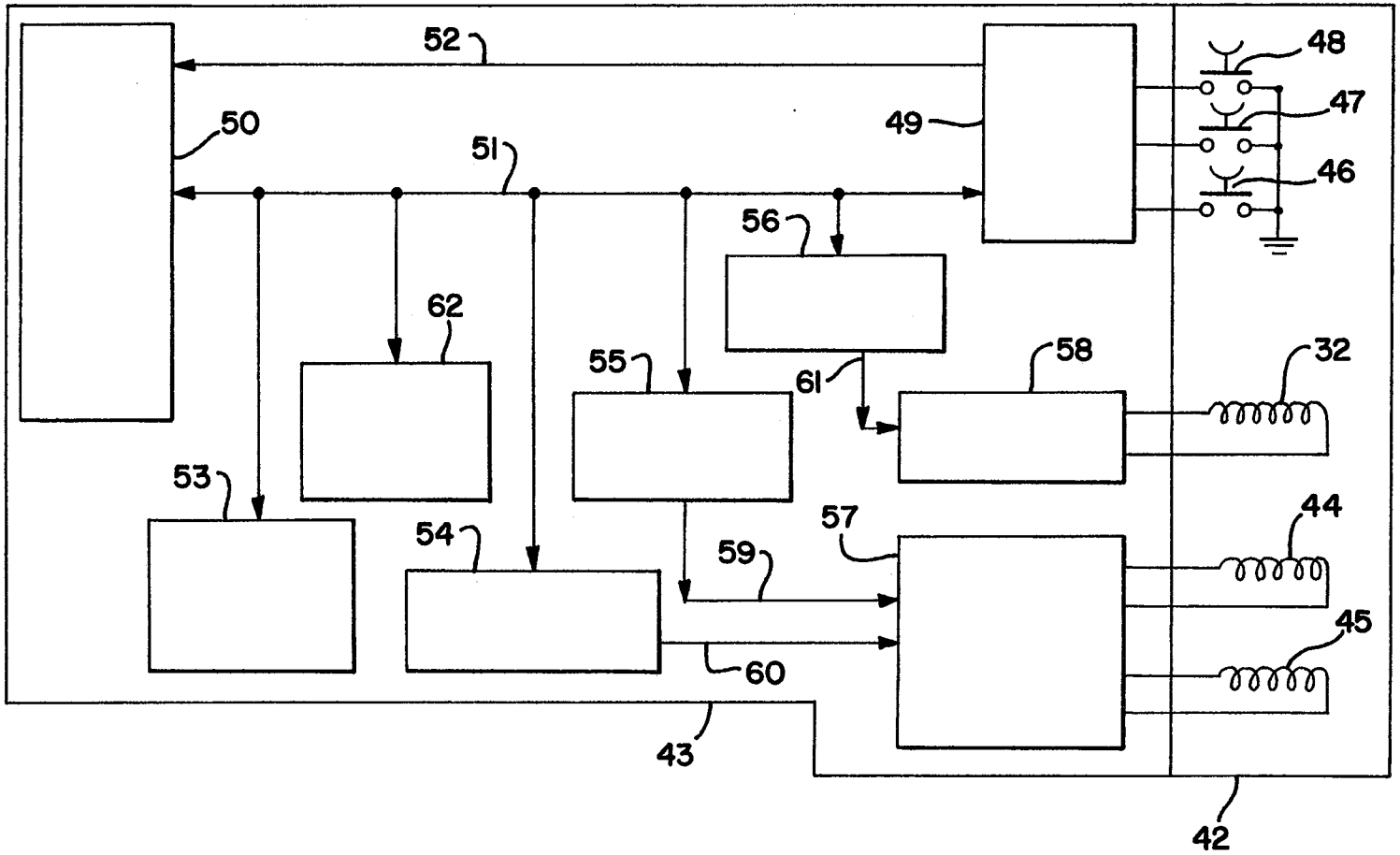
FIG. 4 shows in block diagram a printing apparatus in accordance with the invention.

The printing apparatus shown in FIG. 4 and the print head shown in FIG. 3 provide such functionally.

FIG. 3 shows in section view a preferred form of embodiment of dot matrix print head in accordance with the invention.

The print head, is basically of a known type, in which a plurality of electromagnets (electromagnets 1,2 are shown in FIG. 1), are radially distributed around an axis A—A, hereinafter the print head axis.

Each electromagnet comprises at least an inner pole element 11,12 and an outer pole element 13,14.

Each of the electromagnets is provided with an energization coil 3,4 preferably wound on a reel 5,6 provided with conductive pins 7,8 for insertion in openings of a printed circuit board 9 and soldering thereto.

The set of electromagnets may be encased in a plastic molding to form a unitary subassembly, as disclosed in U.S. Pat. No. 4,433,927 and corresponding EP-A-0058901, or as shown may be inserted in a light alloy frame 10.

A plastic insulating spacer 83 prevents electrical conductive contacts from being formed between the printed circuit board 9, the pins 7,8 and the frame 10.

A portion 10A of the printed circuit board extends outwardly to the frame and provides access to the electrical circuits by a connector 108.

Clearly this is only a preferred form of embodiment and other mechanical arrangments may be used.

A magnetic armature, in form of a metal plate 15,16, each having an arm 17,18 extending radially inwardly towards the axix A—A, is coupled to each of the electromagnets, as a component thereof, for pivotal movement around an inner edge (or a location proximate thereto) of the innermost electromagnet pole element.

The armatures are held in rest position in a known manner, by a cap 19, provided with an O-RING 20 which retains the armature in contact with the pole pieces and at the same time bias them in rest position.

The rest position is defined by an abutment element 21 common to the armature of all the electromagnets, centrally located and provided with an O-RING 22 on which the inwardly extending arm of each armature rests.

The cap 19 is further provided with a guiding nose 23 for guiding a plurality of needle printing elements 25,26 up to a printing location where the needles tips may press an ink ribbon 80 against a printing medium 81, the printing medium resting on a platen 82.

The needle printing elements may be each fixed, at one end thereto, to the ending portion of a corresponding armature inwardly extending arm, by brazing.

The printing elements may also be coupled, each to a corresponding inwardly extending arm, without being fixed thereto.

In this case each needle end is provided in known manner with a small head blased against the related armature arm.

This embodiment is shown for needle 26, which is provided with a head 27, urged against the extending arm 18 by a bias spring 28.

The rest position of the armatures may be dynamically changed on request, by energization of an air gap changing electromagnet.

The gap controlling electromagnet comprises a cylindrical ferromagnetic pot 29 having a bottom 30 and a central core 31.

A coil 32, wound on a coil reel 33, is inserted in the magnetic pot.

The coil reel is provided with connection pins 35,36 which, through openings of pot 29, are inserted in openings of the printed circuit board 9, soldered thereto and provide electrical connection of the coil ends to electrical conductors of the printed circuit board.

The central core 31 and the ferromagnetic pot 29 are clamped together and steadily fixed to the frame 10 by a locking screw 37.

The same screw locks an annular flange 38 of non magnetic material to the top of the central core 31.

The annular flange 38 supports in a suitable recess a resilient O-RING 39.

The annular flange 38 and the resilient O-RING 39 form a second abutment member having a fixed position relative to the electromagnet.

On the contrary, the abutment element 21 in form of an annular bushing is slidably inserted on the central core 31 and axially movable from a first position in which the element 21 is urged against the annular flange 38 by a biasing coil spring 40, to a second position in which the element 21, of ferromagnetic material, is attracted in contact with the top of the pot 29 by the energization of winding 32.

When the abutment element 21 is in the first position the O-RING 22 as shown in FIG. 3, interferes with the armature arms, overrides the gap set function of the O-RING 39 and sets the armature gap width and the needle stroke collectively for all the armatures, to a lesser value.

The gap width can be precisely set, without need of adjustment, by grinding, in the manufacturing process, the O-RING 22 down to a reference plane having a predetermined distance from the plane defined by the upper grinded surface of the pole pieces 13,11,12,14.

The second position of the abutment element 21 may be easily set in order to assure the intervention of the O-RING 39 as abutment member, prevending interference and contact of the O-RING 22 with the armature arms.

This inactive position does not require any machining in order to achieve a predetermined precision.

It is readily apparent that by controlling the energization of the coil 32, the rest position of the electromagnet armatures, such as 15,16 the related gap width and the related printing element stroke can be easily and dynamically changed from one to the other of two precisely defined rest position, gaps and strokes.

Further this functionally can be easily combined with a corresponding adjustment of the printing electromagnets energization.

FIG. 4 shown in block diagram a preferred embodiment of printing apparatus in accordance with the invention and using a print head as the one described.

The printing apparatus comprises an electromechanical unit 42 and an electronic control unit 43.

The electromechanical unit 42 comprises the mechanisms, the motors and the actuators which provide the actuation of the printing needles, the movement of a carriage supporting the printing head, relative to a printing medium, the advancement of the printing medium.

In particular windings 44,45 represent the coils of two of a plurality of printing elements, usually 9 or 18 or even more.

Winding 32 is the energization coil of the gap controlling electromagnet.

Push buttons 46,47,48 are exemplary of manually operated control signal generators which allow the operator to input control signals to the printer electronic control unit 43. These control signals define certain operative modes of the printer.

In particular push botton 46, when pressed a first time, sets an operative mode for printing on multiple copy forms or papers and when pressed a second time resets an operative mode for printing on single copy forms or papers.

A register 49, in the control unit 43, latches the operative mode status.

Control unit 43 comprises a microprocessor 50 connected to a system bus 51, for input output of data/addresses/control signals, and further connected to an interrupt bus 52 for receiving interrupt signals.

The system bus 51 is further connected to a read only memory ROM 53 which is referenced by microprocessor 50 for reading therefrom a sequence of instructions, organized in suitable programs for controlling the operation of the printer, and to a read write memory 62 for storing and retrieving variable information.

A programmable timer 54, connected to the system bus 51, is used by the microprocessor for timing purpose and specifically for establishing the duration of the energization time of the printing electromagnets.

A printing register 55, connected to the system bus 51, is used to latch control information, received from microprocessor 50, establishing which of the printing electromagnet have to be actuated.

Likewise a control register 56, connected to the system bus 51, is used to latch control information establishing which of several motor means, such as electromagnets, step motors, DC motors of the electromechanical unit 42, have to be energized.

The outputs of registers 54,55 are connected to inputs of a set of driving circuits 57 by lead sets 59,60 respectively.

The set of driving circuits 57, which for instance may be implemented as shown in U.S. Pat. No. 3,909,681, is coupled to windings 44,45 of the printing electromagnets for their energization.

An output 61 of control register 56 is connected to an input of driving circuit 58, which provides the powering of winding 32 of the gap changing electromagnet.

The operation of the printing apparatus is a follows.

Before starting a printing operation, the operator, by actuation of push button 46, establishes or sets the printing mode for printing either on a single copy sheet or on a multiple copy form. Register 49, so set, provides an interrupt signal to microprocessor 50, which reads register 49 and depending on its status, loads control register 56, timer 54 and memory 62 with suitable control information. Thus winding 32, depending on the need to print multiple copies or not, is energized or not, thus setting the rest position of the printing electromagnet armatures as required.

At the same time, timer 54 is preset to provide a timing signal having a duration corresponding to the required duration of the printing electromagnets energization time.

When the printing operation starts, every time the printing register 55 is loaded with a pattern establishing which of the printing electromagnets have to be energized, the programmable timer 54 is triggered so as to provide a timing signal for such energization. Clearly the microprocessor 50 also reads, from memory 62 or 58, the information required to adjust the print head advancement speed, relative to the printing medium, and the frequency at which the printing register 55 is loaded and the printing electromagnets are actuated, depending on the energization time and deenergization time needed by the printing electromagnets for the selected printing mode.

It is clear that the preceding description is related to a preferred embodiment of the invention and that several changes can be made.

Particularly in case of print heads where the electromagnet armatures and related actuation arms form a lever of the first genus, as shown in FIG. 3, the first abutment member, fixed relative to the electromagnetic structure, may be provided by a resilient member, such as an O-RING 84 acting as a stop member for the armature end opposed to the outer pole piece 13.

Further the control function provided by coil 32 and spring 29 may be reversed, and the abutment member 21 may be held in operative or active position by energization of an electromagnet and may be held in unactive position by a resilient biasing element.

Furthermore the mechanical actuator for the movable abutment member 21 needs not to be an electromagnet but may even be a step motor, a thermomechanic actuator, where a stroke is caused by the changes in volume of a heated substance or else.

Further the timing function performed by the programmable timer 54 may be formed by the microprocessor 50 executing suitable timing routines.

I claim:

1. Dot matrix printing head comprising a plurality of printing electromagnets, each having a magnetic core, a winding magnetically coupled to said core and a movable armature coupled to a printing element and resiliently biased away from said core and towards a first abutment member, common to the armatures of said plurality of electromagnets, in a fixed position relative to said plurality of electromagnets and defining a first gap width between said armature and said magnetic core due to each of said armatures abutting the first abutment member, comprising:

a second abutment element, movable from a first position to a second position in which said second abutment element defines a second gap width between said armature and said magnetic core due to each of said armatures abutting the second abutment member, and motor means, coupled to said second abutment member and operable to move said second abutment element in either one or another of said two predetermined positions, whereby the gap width between said armature and said magnetic core may be dynamically set in dependance of either one or another of two printing modes.

2. Dot matrix printing head as in claim 1, where said armatures are each provided with an actuation arm, are substantially arranged in a plane and radially extending inwardly with said arm to a central axis of said print head, perpendicular to said plane, said motor means consisting in a gap control electromagnet having a cylindrical movable bushing, the axis of said cylindrical bushing being coincident with the axis of said print head, said second abutment element being part of said bushing and providing a stop for said actuation arms.

3. Dot matrix printing head as in claim 2, further including a printed circuit board and coil reels on which said windings of said printing electromagnets are wound, said coil reels having connection pins soldered to said printed circuit board, said gap control electromagnet having a coil and a coil reel, said coil reel having connection pins soldered to said printed circuit board.

4. Printing apparatus comprising a dot matrix printing head including a plurality of printing electromagnets, each having a magnetic core, a winding magnetically coupled to said core and a movable armature coupled to a printing element, said apparatus further comprising first control means for controlling the operation of said printing electromagnets and a first abutment member, common to the armatures of said plurality of electromagnets and defining a first gap width between said armatures and said magnetic cores due to each of said armatures abutting the first abutment member, comprising:

a position controllable second abutment element for said armatures, capable of assuming either one or another of at least two position, one of said two positions defining a second gap width between said armatures and said magnetic cores of said plurality of printing electromagnets due to each of said armatures abutting the second abutment member, motor means, coupled to said second abutment element, for moving said second abutment element to either said one or said other position, second control means for controlling the operation of said motor means, said first control means being operative to change the duration of energization of said printing electromagnets, depending on said second abutment element being moved to said one or the other of said two positions.

5. Printing apparatus as claimed in claim 4 where said first control meand is operative to change the energization frequency of said printing electromagnets and the advancement speed of said print head, relative to a printing medium, depending on said second abutment element being moved to said one or the other of said two positions.

* * * * *